US005595058A

United States Patent [19]

Billner

[11] Patent Number: 5,595,058

[45] Date of Patent: Jan. 21, 1997

[54] OPEN-END SPINNING DEVICE

[75] Inventor: Werner Billner, Ingolstadt, Germany

[73] Assignee: Rieter Ingolstadt Spinnereimaschinenbau AG, Ingolstadt, Germany

[21] Appl. No.: 468,376

[22] Filed: Jun. 6, 1995

Related U.S. Application Data

[62] Division of Ser. No. 183,599, Jan. 21, 1994, Pat. No. 5,471,829.

[30] Foreign Application Priority Data

Mar. 25, 1993 [DE] Germany ..... 43 09 704.9

[51] Int. Cl.[6] ..... D01H 4/38

[52] U.S. Cl. ..... 57/413; 57/412

[58] Field of Search ..... 57/406, 407, 408, 57/409, 410, 411, 412, 413

[56] References Cited

U.S. PATENT DOCUMENTS

| | | | |
|---|---|---|---|
| 3,538,698 | 11/1970 | Ripka et al. . | |
| 3,591,952 | 7/1971 | Ripka et al. . | |
| 3,927,516 | 12/1975 | Stahlecker | 57/407 |
| 4,291,528 | 9/1981 | Miyamoto et al. . | |
| 4,660,374 | 4/1987 | Wassenhoven | 57/407 |
| 4,753,067 | 6/1988 | Landwehrkamp et al. | 57/408 X |
| 4,879,873 | 11/1989 | Kawabata et al. . | |
| 5,111,651 | 5/1992 | Pohn et al. | 57/411 X |
| 5,337,552 | 8/1994 | Schuller et al. | 57/406 |

FOREIGN PATENT DOCUMENTS

| | | | |
|---|---|---|---|
| 311988 | 4/1989 | European Pat. Off. | 57/413 |
| 2623400 | 3/1977 | Germany . | |
| 3734544 | 12/1987 | Germany . | |
| 4123255 | 1/1993 | Germany . | |
| 4121183A1 | 1/1993 | Germany . | |
| 4121183 | 1/1993 | Germany | 57/408 |
| 609753 | 10/1948 | United Kingdom . | |
| 2132240 | 7/1984 | United Kingdom . | |
| 2192010 | 12/1987 | United Kingdom . | |

*Primary Examiner*—William Stryjewski
*Attorney, Agent, or Firm*—Dority & Manning

[57] ABSTRACT

In an open-end spinning device the spinning rotor can be replaced by a spinning rotor with a different diameter. Furthermore, the opener device is capable of being displaced in relation to the spinning rotor. The rotor cover can be adapted through replacement on the one hand to replacing the spinning rotor, and on the other hand to the then applicable position of the opener device.

3 Claims, 5 Drawing Sheets

OPEN-END SPINNING DEVICE

This is a division of application Ser. No. 08/183,599, filed Jan. 21, 1994 now U.S. Pat. No. 5,471,829.

BACKGROUND OF THE INVENTION

The instant invention relates to an open-end spinning device, and more particularly with a fiber collection groove and a spinning rotor with one open side which can be replaced by a spinning rotor of different diameter, with a rotor cover covering the open side of the spinning rotor, with an opener device as well as with a fiber feeding channel beginning in the opener device and ending in the rotor cover across from the inner wall of the spinning rotor.

When spinning rotors are replaced by spinning rotors of different diameter it is necessary, in addition to replacing the spinning rotor itself, to replace also the rotor cover which contains part of the fiber feeding channel which is in turn adapted to the rotor diameter through appropriate bending (DE 37 34 544 A1). It has been shown that such a bending of the fiber feeding channel has a considerable influence on the deposit of fibers on the fiber collection surface. If the orientation of the fiber feeding channel is optimized with respect to a given rotor diameter, it is disadvantageous with respect to a different diameter rotor and this results in lower yarn quality, in particular with respect to uniformity and strength of the yarn.

OBJECTS AND SUMMARY OF THE INVENTION

It is therefore a principal object of the instant invention to provide an open-end spinning device which the above-mentioned disadvantages are avoided and so that optimal conditions are achieved also with different forms and sizes of the spinning rotor with respect to the arrangement and orientation of the fiber feeding channel. Additional objects and advantages of the invention will be set forth in part in the following description, or will be obvious from the description, or may be learned from practice of the invention.

The objects are attained by the invention in that the opener device is mounted so that it can be shifted relative to the spinning rotor and in that the rotor cover can be adapted through replacement to a replacement spinning rotor on the one hand and on the other hand to the relevant position of the opener device. The opener device is provided in the usual fashion with part of the fiber feeding channel which can be brought into position through shifting so that the continuation of the fiber feeding channel can always be provided in the desired manner independently of the form of size of the spinning rotor. This continuation of the fiber feeding channel is located in the rotor cover which is adapted to the newly installed spinning rotor, i.e. to its form and size on the one hand, and to the new position of the opener device on the other hand.

In a preferred embodiment of the invention, the opener device is capable of being displaced within a plane that is parallel to the fiber collection groove.

Opener devices are preferably capable of being displaced and the rotor cover is capable of being replaced in such a manner that the fiber feeding channel is always aligned in the same manner, perpendicularly to the plane going through the fiber collection groove, independently of the diameter of the spinning rotor used. In this manner the fiber flow, parallel to the plane going through the fiber collection groove can always be influenced in the same manner. It is especially advantageous here if the opener device is capable of being displaced, and the rotor cover is capable of being replaced in such manner that the center line of the fiber feeding channel extends over the entire length of the fiber feeding channel within a plane parallel to the rotor axis, independently of the diameter of the spinning rotor. In this manner, the fiber feeding channel takes a straight course along this plane.

The opener device need not be capable of linear displacement, but in another advantageous embodiment of the device according to the invention, it may be mounted so as to be capable of being rotation-adjusted.

To ensure that the fiber feeding channel can also be adapted perpendicularly to the fiber collection groove to the selected diameter of the spinning rotor or to its form, it is furthermore advantageous for the opener device to be mounted in a second plane perpendicular to the first plane which is parallel to the fiber collection groove so that it may be displaced relative to the spinning rotor.

Instead of this adjustability through displacement of the opener device at a perpendicular to the fiber collection groove or in addition thereto, it is possible to provide in another advantageous embodiment of the invention for the fiber feeding channel to let out into a slit extending radially with respect to the spinning rotor.

To be able to adjust the opener device easily, a slit guide is advantageously associated with the opener device.

In an alternate, advantageous embodiment of the device according to the invention it is possible to provide for the opener device to be mounted on two axles in such manner that it can be detached from one axle in order to be displaced and can be swivelled around the other axle.

The opener device or the part of the machine frame is advantageously provided with a marking which interacts with a scale on the other one of these two parts. In this case it is advantageous for the scale to be provided with subdivisions corresponding to the diameters of the spinning rotors to be used.

In order to be able to arrest the opener device in its set positions, an arresting device is provided for the opener device in an advantageous embodiment of the invention, the arresting device being preferably equipped with a catch system to arrest the opener device in the predetermined locked positions.

The invention is simple in structure and can be used to advantage with different designs of open-end spinning devices. It makes it possible to achieve optimal fiber feeding to the spinning rotor in spite of different rotor diameters and configurations by replacing only the spinning rotor and its rotor cover and without having to replace the entire opener device. Thanks to the always optimized fiber feeding to the rotor wall, independently of the spinning rotor used, the fibers are deposited in the fiber collection groove with improved parallel orientation so that the yarn produced from these fibers is of better quality than in the past, in particular with regards to uniformity and strength.

Examples of embodiments of the invention are explained in further detail below through drawings.

DETAILED DESCRIPTION OF THE PREFERRED EMBODIMENTS

Figure 1:
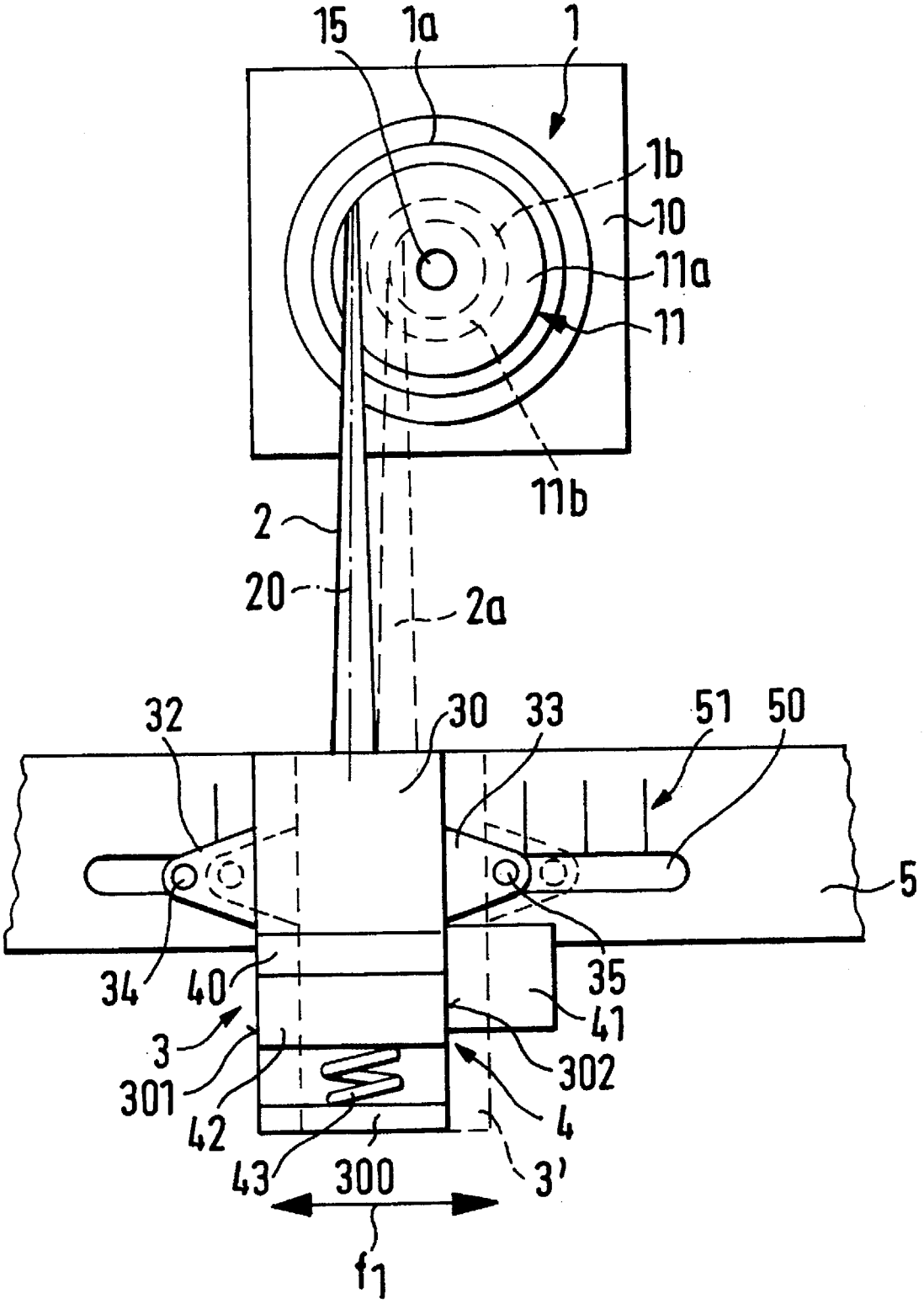
FIG. 1 is a schematic front view of an open-end spinning device according to the invention, with an opener device that is adjustable parallel to the longitudinal machine axis for adaptation to spinning rotors of different sizes.

Reference will now be made in detail to the presently preferred embodiments of the invention, one or more examples of which are illustrated in the drawings. Each example is provided by way of explanation of the invention, and not limitation of the invention. For example features illustrated or described as part of one embodiment can be used on another embodiment to yield a still further embodiment. The numbering of components is consistent throughout the description with the same components having the same numbers throughout.

The figures by means of which the invention is explained below only show those elements which are absolutely necessary to understand the invention. Thus for example, the elements required to withdraw the spun yarn are not shown for the sake of clarity.

FIG. 1 shows an open-end spinning device which is, as a rule, part of a machine with a machine frame and with a plurality of identical open-end spinning devices placed next to each other. Each open-end spinning device is equipped with a rotor cover 10 which covers the open side of a spinning rotor 1. In addition to a fiber draw-off channel 15 which is shown only in FIG. 1, a fiber feeding channel 2 is installed in the rotor cover 10, said fiber feeding channel 2 having its start in an opener device 3 and ending in the rotor cover 10, across from the inner wall 100 of the spinning rotor 1.

Figure 2:
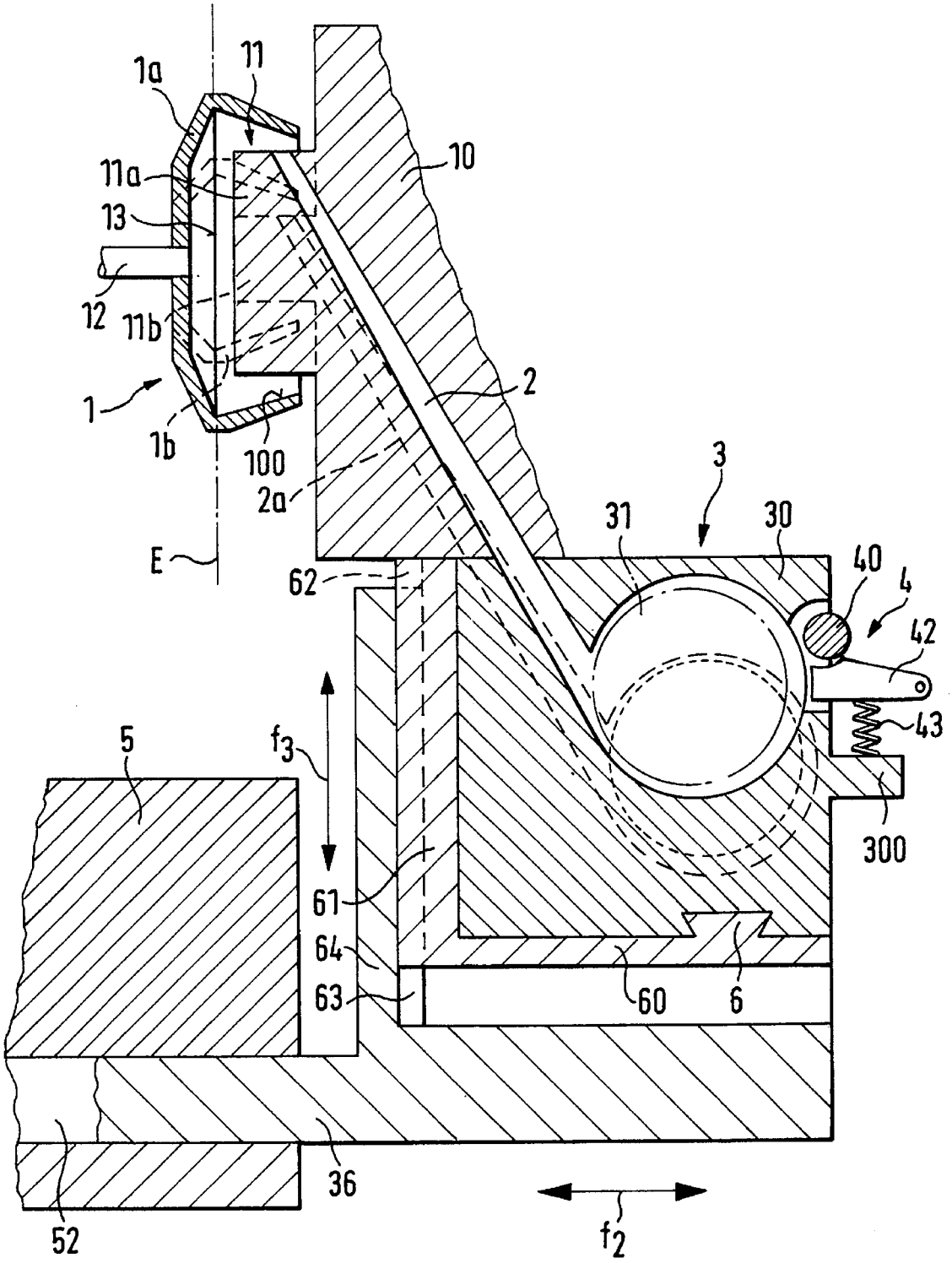
FIG. 2 is a schematic side view of a variant of the device shown in FIG. 1, with an opener device adjustable in three planes.

An essential element of the opener device 3 is a housing 30 with an opener roller 31 (see FIG. 2). The housing 30 of the opener device 3 has lateral, integrated attachment brackets 32 and 33 with openings through which the attachment screws 34 and 35 are extending, by means of which the housing 30 is attached to a part 5 of the machine frame.

The opener device 3, together with a delivery device 4, forms one component. The delivery device 4 has a delivery roller 40 which can be driven by a drive motor 41. A feeding trough 42 interacts in a known manner with the delivery roller 40, the feeding trough 42 bearing upon an extension arm 300 of the housing 30 of the opener device 3 via a compression spring 43 and being held in elastic contact against the delivery roller 40.

Figure 3:
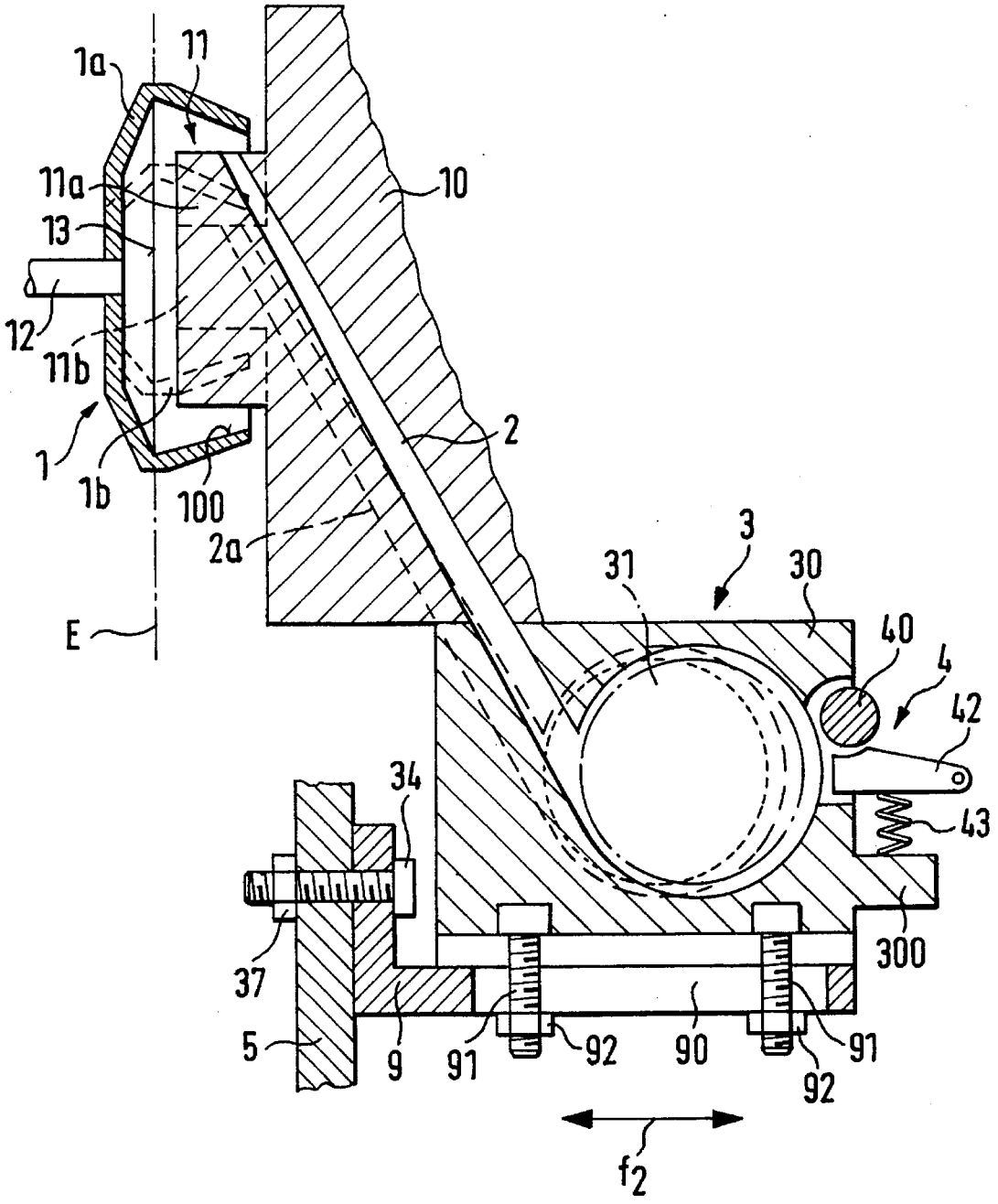
FIG. 3 is a schematic side view of another variant of the device shown in FIG. 1, with an opener device adjustable in a second plane, parallel to the rotor axis.

The component consisting of the opener device 3 and the delivery device 4 is installed as a unit by means of a slit guide on the part 5 of the machine frame so as to be adjustable. This slit guide is provided with a slit 50 in the part 5 through which the attachment screws 34 and 35 extend, each of them provided with a nut 37 (FIG. 3). The slit is associated with a scale 51 which interacts with the lateral edge of the attachment bracket 32 or 33 as a marking. The scale 51 has divisions corresponding to the different rotor sizes to be used.

FIG. 1 shows two spinning rotors 1*a* and 1*b* which can be used alternatively and of which the spinning rotor 1*a* has a large diameter and the spinning rotor 1*b* has a small diameter. Correspondingly, the extension 11 is also of different size, depending on which spinning rotor, 1*a* or 1*b* is used (see extension 11*a* with large diameter, which is associated with the large spinning rotor 1*a*, as well as extension 11*b*, with small diameter, with is associated with the small spinning rotor 1*b*).

FIG. 1 shows that the opener device 3 is adjustable in the direction of arrow $f_1$, parallel to the longitudinal machine axis along which the part 5 of the machine frame extends. This is indicated by the broken-line representation of the opener device 3 in its other position (see opener device 3') in FIG. 1.

If it is assumed that for a given rotor size and configuration, the arrangement and design of spinning rotor 1 as indicated by solid lines (see spinning rotor 1*a*), rotor cover 10 (with extension 11*a*), fiber feeding channel 2 and opener device 3 yields the best results with respect to yarn breakage, this can be attributed at least in major part to the layout and the course of the fiber feeding channel 2. According to FIG. 1, the fiber feeding channel 2 follows a straight course, at least in the view shown. This means that the fiber/air stream which, as is known, is produced by the negative spinning pressure in the spinning rotor 1, is normally substantially centered as it reaches the fiber feeding channel 2 after leaving the housing 30 of the opener device 3, remains centered also in the fiber feeding channel 2 and is conveyed neither to one nor to the other of the sides forming a wall in FIG. 1. In this manner the fibers conveyed in this fiber/air stream from the opener device 3 to the spinning rotor 1 are prevented from spreading out over this wall of the fiber feeding channel 2 constituting a side wall in FIG. 1, which would represent a spreading out of the fibers in the axial direction along the rotor wall. The fibers would then have to cover gliding paths of different lengths into the fiber collection groove 13 of the spinning rotor 1, and this would lead to interference of fibers among each other along this gliding path and therefore to irregular yarns.

These disadvantages are avoided by the device shown in FIG. 1 and described above in their structure, in that by avoiding lateral bends in the fiber feeding channel 2 (with reference to the representation shown in FIG. 1), the fibers continue to be centered as before and are therefore deposited substantially on one and the same contour line (parallel to the plane E going through the fiber collection groove 13) of the spinning rotor 1. All the fibers fed into the spinning rotor 1 have thus covered the same gliding path along the inner wall 100 (FIG. 2) of the spinning rotor 1 up to its fiber collection groove 13. The fibers therefore glide along parallel, helicoidal gliding paths of equal length and parallel into the fiber collection groove 13 without interfering with each other. As a result a more uniform fiber ring is produced in the fiber collection groove 13, and this in turn results in uniform yarns of high quality, in particular with respect to strength.

Depending on the processed staple length of the fibers to be spun, spinning rotors 1 of different diameters and configurations are used, and to these the rotor cover 10 with the portion of the fiber feeding channel 2 which it contains must then be adapted.

For example, the spinning rotor 1*a* with the large diameter is replaced in a known manner by a spinning rotor 1*b* with a small diameter in adaptation to the fiber material.

In order to avoid the previously used and unavoidable angle in the course of the fiber feeding channel 2 in adapting the rotor cover 10, the opener device 3 is adjustable along arrow $f_1$ in a parallel direction to the plane defined by the fiber collection groove 13.

As FIG. 1 shows, the fiber feeding channel 2 follows essentially the same straight course in the representation of FIG. 1, in the position in which the fiber channel 2 extends into the large spinning rotor 1*a* as well as in the position shown by a broken line (fiber channel 2*a*) in which this channel extends into the small spinning rotor 1*b*. This is achieved in that the opener device 3 is displaced along the scale 51 laterally along arrow $f_1$ as a function of the increase in size of the radius of spinning rotor 1. The fiber feeding channel 2, which is essentially part of the rotor cover 10, is here replaced together with the rotor cover 10 in a known manner. At the same time the rotor cover 10 is adapted to the new form and size of the spinning rotor 1 used as well as to the applicable position of the opener device 3.

It goes without saying that if more than only two different rotor sizes can be used, as many adjustment positions of the opener device 3 and as many configurations and sizes of the rotor cover must be provided.

As will be explained further below through FIG. 2, the adjustment of the opener device 3 can be effected horizontally, in the longitudinal sense of spinning machine normally equipped with a plurality of identical open-end spinning devices, or in a vertical direction, or else in the horizontal as well as in the vertical direction.

Only the horizontal adjustment of the opener device 13 in relation to the spinning rotor in the longitudinal sense of the machine and parallel to the plane E going through the fiber collection groove 13 is described first of all through the example of FIG. 1. To achieve this, the two attachment screws 34 and 35 are loosened and the opener device 3, together with the delivery device 4 which it supports in its entirety is displaced in the longitudinal sense of the machine, parallel to the plane E going through the fiber collection groove 13 (FIGS. 2 and 3) until its right or left lateral edge (301 or 302) coincides with the division line of scale 51 which corresponds to the spinning rotor 1*b* which will now be used.

If the opener device 3 has assumed the desired position (see opener device 3' in FIG. 1), the two attachment screws 34 and 35 are tightened again and the opener device (3') is thereby arrested in its new position.

Following this adjustment of the opener device 3, the rotor cover 10 must be replaced in a known manner. This rotor cover 10 supports the major portion of the fiber feeding channel 2 which (as shown in FIG. 1) follows an unchanged course in the plane parallel to the axis of the spinning rotor 1, with the restriction that it is slightly shorter because of the smaller diameter of the spinning rotor 1. Because of the unchanged course of the fiber feeding channel (see fiber feeding channel 2*a* indicated by broken lines) the influence on fibers during fiber transportation from the opener device 3' into the spinning rotor 1*b* is unchanged from that when a spinning rotor 1*b* with a larger diameter is used. This means that all the advantages with respect to fiber deposit on the inner wall 100 of the spinning rotor 1, with respect to gliding along parallel gliding paths that do not interfere with each other on the inner wall 100 of the spinning rotor 1 as well as with respect to orderly deposit of fibers in the fiber collection groove 13 are obtained equally as well with a spinning rotor 1*a* with a large diameter as with a spinning rotor 1*b* with a small diameter.

As mentioned above and as can be seen from FIG. 1, the distance between the opener device 3 (3') and the spinning rotor 1*b* is smaller when a smaller spinning rotor 1*b* is used than the distance between the opener device 3 and a spinning rotor 1*a* with a larger diameter. In order to ensure that the fibers can nevertheless be conveyed in the desired manner to the inner wall 100 of the spinning rotor 1, the fiber feeding channel 2 must be bent differently parallel to the plane of the drawing in FIG. 6 to adapt to the rotor diameter. It has been shown that such a bending of the fiber feeding channel 2 (contrary to forming an angle at a right angle to the plane of the drawing of FIG. 6, which is to be avoided) as a rule offers advantages, as the fibers are collected on a wall 260 of the fiber feeding channel 2 due to such a bending, whereby this wall extends essentially parallel to a contour line of the spinning rotor 1, parallel to the plane E going through the fiber collection groove 13. The fibers are thus deposited in a targeted manner along a contour line of the spinning rotor 1 on the inner wall 100 of same, and this effect can be further assisted in that the wall 260 of the fiber feeding channel 2 on which the fibers are collected does not have a concave but rather an even slightly convex form.

Figure 6:
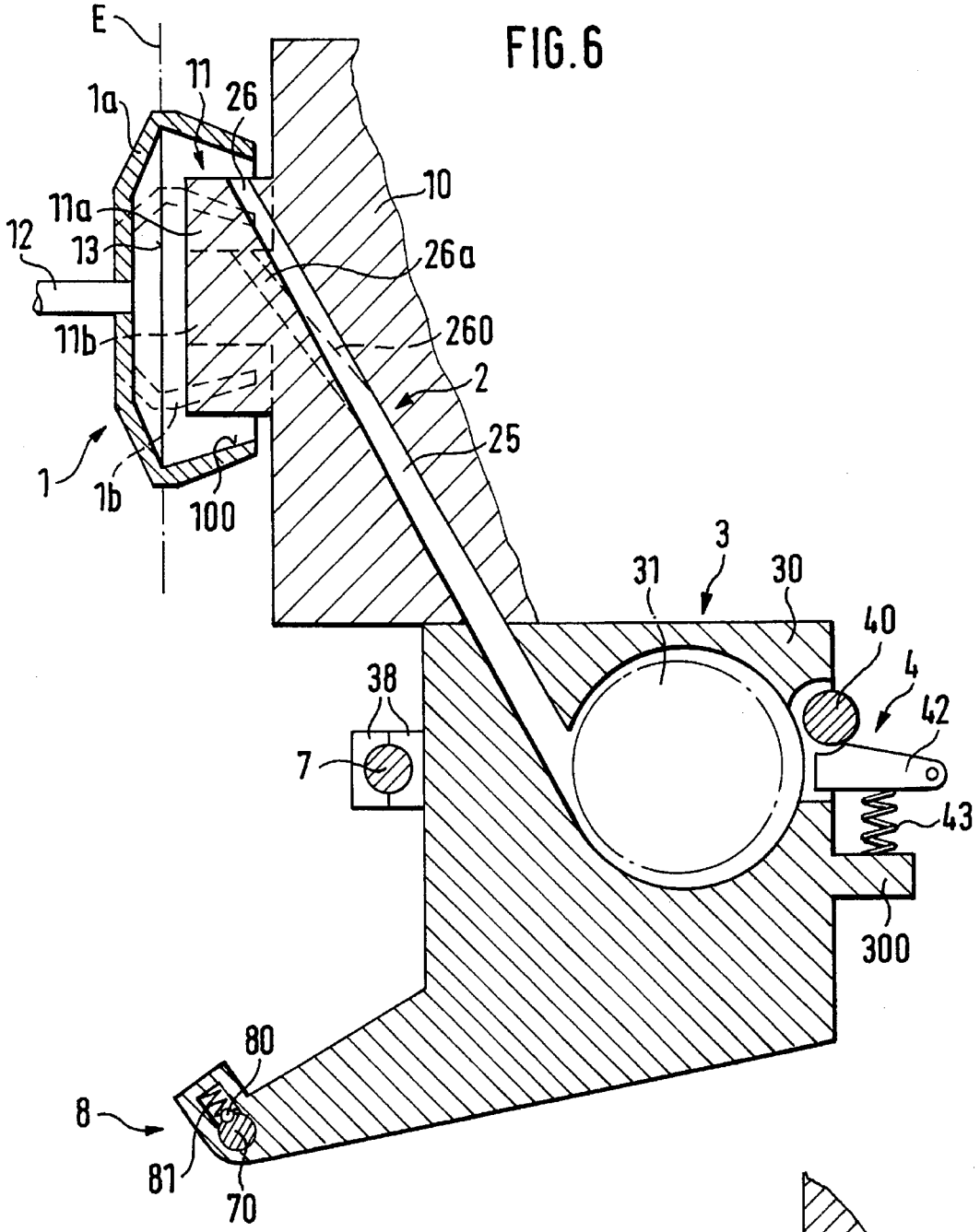
FIG. 6 shows a variant of the spinning device according to the invention in which the opener device is adjustable on two axles.

Such a bend in the fiber feeding channel 2 is shown in FIG. 6. Here a straight course of the fiber feeding channel 2 for a spinning rotor 1*a* with larger diameter is provided, while the course with a spinning rotor 1*b* with a smaller diameter extends at an angle. The course of the first longitudinal segment 25 is the same in either case. While the second longitudinal segment 26 constitutes the continuation of the first longitudinal segment 25 with a large rotor diameter, the second longitudinal segment 26*a* is at an angle to the first longitudinal segment 25 with a small rotor diameter so that the axial projection of the first longitudinal segment 25 falls on the wall 260 of the second longitudinal segment 26*a*. Such an arrangement of the two longitudinal segments 25 and 26*a* causes the fibers to be forced towards wall 260 as they are being conveyed to the spinning rotor 1*b* and to be conveyed to the inner wall 100 of the spinning rotor 1*b* along wall 260. The fibers spread out along this wall 260 during their transportation so that they are distributed in the circumferential direction of the spinning rotor 1*b*. The more this spreading out is made possible by means of appropriately flat configuration and parallel positioning of the wall 260 in relation to a contour line of the spinning rotor 1*b*, the better will be the depositing of the fibers on the inner wall 100 of the spinning rotor 1*b* and the quality of the yarn produced.

The fibers need not necessarily be deposited from the fiber feeding channel 2 directly on the wall 100 of the spinning rotor 1. It is rather possible to apply the described principle with a design of an open-end spinning device in which a conical gliding wall (not shown) which widens in the direction of the spinning rotor 1 extends into the open side of the spinning rotor 1. In such a design the fiber feeding channel 2 lets out across from or in this gliding wall which is separated from the spinning rotor 1, and which may be stationary or rotatable during operation relative to the spinning rotor 1. The size of this gliding surface preceding the spinning rotor 1 depends on the diameter of the spinning rotor 1 and must also be replaced when the spinning rotor 1 is replaced. This gliding wall which is separate from the spinning rotor 1 may, for example, be an integral part of the rotor cover 10, so that when the rotor cover 10 is replaced, this gliding surface is necessarily also replaced.

To ensure that the fiber feeding channel 2 follows a course without bends, independently of the size of the spinning rotor 1 or of its associated gliding surface, provisions may be made according to FIG. 2 for the opener device 3 to be adjustable not only parallel to the longitudinal machine axis or parallel to the plane E going through the fiber collection groove 13, but to be adjustable also in a second plane which is perpendicular thereto. This adjustment can here be either in a horizontal or in a vertical direction, as desired. For this purpose the housing may be provided, in addition to a guide 6 in the longitudinal sense of the machine, with an additional guide 52 perpendicular to the longitudinal machine axis, installed in part 5 of the machine frame in the embodiment according to FIG. 2. A rail 36 on which a bearing plate 60 with the guide 6 is mounted may extend in this case through the guide 52, for example. The bearing plate 60 is part of a sled 61 with a guide 62 which is mounted in a counter-guide 63 of an additional bearing plate 64 so as to be capable of vertical displacement.

Thanks to this multiple adjustability of the opener device 3 in three planes, the course of the fiber feeding channel 2 can remain substantially unchanged in its entirety, so that also the depositing of fibers on the inner wall 100 of the spinning rotor 1 remains unchanged, independently of the latter's diameter. As a result, and whatever the size (diameter) of the spinning rotor 1 selected may be, the same depositing conditions are always achieved.

Since the depositing of the fibers, including their transportation from the opener device 3 into the spinning rotor 1 is always carried out in the same manner, uniform quality is achieved independently of the selected size or configuration of the spinning rotor 1.

FIG. 2 dispenses with the representation of arresting means in order to improve the clarity of the drawing.

In any case three adjustment possibilities are provided in the embodiment of FIG. 2:

a) The first adjustment is carried out by means of guide 6 in longitudinal machine direction along arrow $f_1$ (see FIG. 1); thereby the adjustment of the fiber feeding channel 2, radially relative to the spinning rotor 1, is made.

b) The second adjustment is horizontal, transversely to the longitudinal sense of the machine and parallel to the rotor axis 12, in the direction of arrow $f_2$ (FIG. 2); in this way the course of the fiber feeding channel 2 can remain unchanged, parallel to a plane going through the rotor axis 12.

c) The third adjustment is vertical, in the direction of arrow $f_3$; thereby an identical length of the fiber feeding channel 2 is obtained, independently of the size of the spinning rotor 1.

If the displacement of the opener device is possible in more than one plane it is necessary to adjust the delivery device 4 together with the opener device 3, since the delivery device 4 must remain at the same distance from the opener roller 31 of the opener device 4. For this reason, and according to the embodiments described, the delivery device 4 preceding the opener device 3 is an integral part of the opener device 3 and the opener device 3 takes along the delivery device 4 in its entirety, i.e. including the delivery roller 40.

As FIG. 3 shows, it is not absolutely necessary to move the opener device 3 also in the vertical direction. Since the rotor cover 10 must be replaced in any case together with the replacement of the spinning rotor 1 by one of a different size or form, since the extension 11 must be adapted to the selected diameter of the spinning rotor 1*a* or 1*b*, differences in the length of the fiber feeding channel 2 (if such differences can be tolerated, as is usually the case) can also be compensated for through corresponding configuration and size of the rotor cover 10. Thus it suffices according to FIG. 3 to displace the opener device 3 in the direction of arrow $f_1$, i.e. along the spinning machine, as well as to displace it in addition in the direction of arrow $f_2$, i.e. parallel to the rotor axis 12. For these adjustments, a first slit 50 (see FIG. 1) with attachment screws 34 and 35 and with nuts 37 or similar devices as well as a second slit 90 (FIG. 2) with attachment screws 91 and nuts 92 or similar devices are provided. The first slit 50 is located in the part 5 of the machine frame, as shown in FIG. 1. Contrary to the embodiment shown in FIG. 1 however, the opener device 3 is not attached directly to the part 5 but with interposition of a sled 9 in which the slit 90 is provided, along which the housing 30 of the opener device 3 is horizontally adjustable after loosening the attachment screws 91. An adjustment along arrow $f_3$ as shown in FIG. 2 is superfluous since this component is compensated for by an appropriate size of the rotor cover 10.

Tests have shown that under certain conditions it is especially advantageous for the fibers to enter the spinning rotor 1 in their last longitudinal segment 23 (FIG. 4) ending in the spinning rotor 1 on the side wall of the fiber feeding channel 2 towards the rotor axis 12. This is achieved in that the fiber feeding channel 2 is bent in such manner that the continuation of the next-to-last longitudinal segment 22 of the fiber feeding channel 2 comes to lie on the side wall 230 of the last longitudinal segment 23 towards the rotor axis 12 of the spinning rotor 1. In this manner the fibers which are conveyed in fiber feeding channel 2 to the spinning rotor 1 are thrown against this side wall 230 of the longitudinal segment 23 of the fiber feeding channel 2 along which they move into the spinning rotor 1 as a result of the deflection of the fiber feeding channel 2. As they leave the fiber feeding channel 2, the fibers are deflected in the direction of rotation (arrow $f_4$) of the spinning rotor 1, and this promotes uniform deposit of the fibers in the fiber collection groove 13. This spreading out of the fibers in the direction of rotation (arrow $f_4$) of the spinning rotor 1 is furthermore promoted in that the extension 11 of the rotor cover 10 widens in the direction of rotation (arrow $f_4$) of the spinning rotor 1 in form of a slit (14) that is as narrow as possible and extends in radial direction towards the inner wall 100 of the spinning rotor 1.

Figure 7:
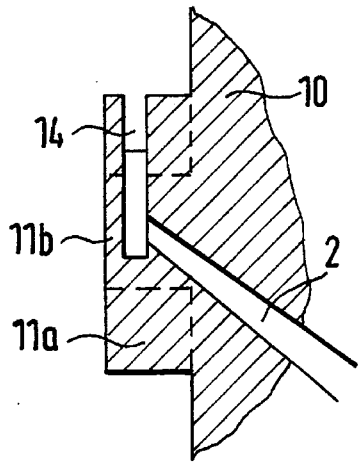
FIG. 7 shows a longitudinal section of a detail of the device shown in FIG. 4.

FIG. 7 shows a lateral view of the fiber feeding channel 2 in its area letting out into the slit 14. As this figure shows, the course of the fiber feeding channel 2 can always remain the same with such a design of the extension 11 with a slit 14, independently of the diameter of the spinning rotor 1, so that the deposit of fibers on the inner wall 100 of the spinning rotor 1 or on some other gliding wall preceding the spinning rotor 1 may also be effected in the same manner. In such a case an unmodified fiber feeding channel 2 would also be possible with different diameters of the spinning rotor 1, so that lateral displacement of the opener device 3 along the longitudinal machine axis and a replacement of the rotor cover 10 (and of a gliding wall which may precede the spinning rotor 1) suffices for adaptation to the different rotor diameter. A vertical displacement of the opener device 3 or a horizontal displacement of same, perpendicularly to the longitudinal machine axis is not necessary with this design. Where larger diameters of the extension 11 are used, the slit 14 need merely reach as far as its circumferential surface.

Figure 4:
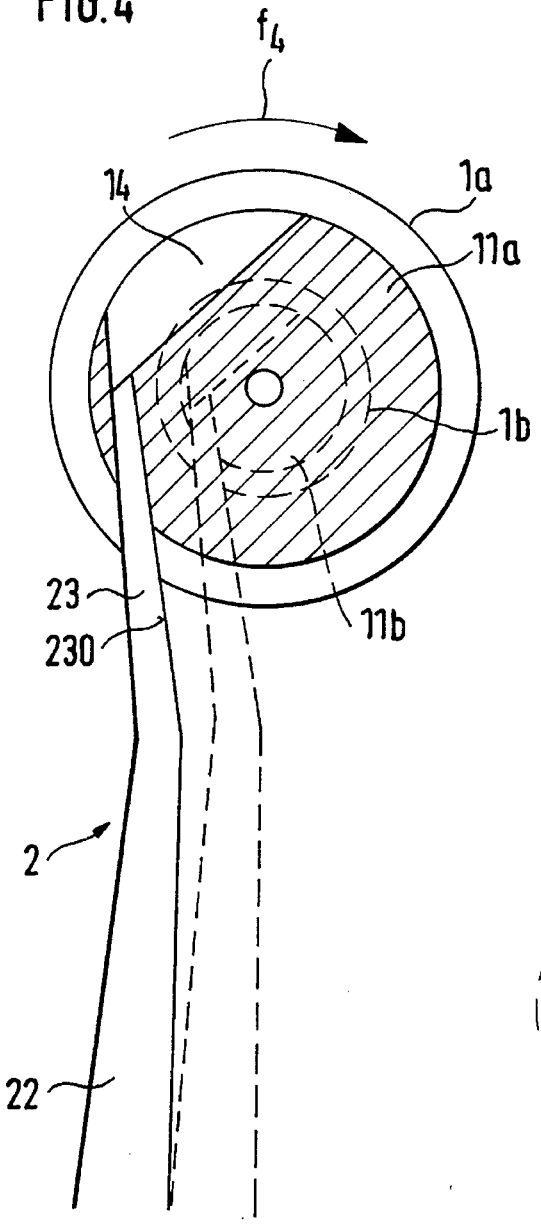
FIG. 4 shows a cross-section of a modified embodiment of the device according to the invention in which the fiber feeding channel forming an angle lets out into a slit.

In an embodiment of the device according to FIG. 1, as well as in an embodiment of the device according to FIG. 4, the fiber feeding channel 2 is always aligned and oriented in the same manner, independently of the diameter of the spinning rotor used, also in the different setting positions of the opener device 3 into which it can be placed and with replaced rotor cover 10, at least in the shown plane, which extends at a perpendicular to the plane going through the fiber collection groove 13. The difference between these two embodiments, with respect to the alignment of the fiber feeding channel 2, consists only in the fact that the fiber feeding channel 2 is always bent in the same manner according to FIG. 4, while according to FIG. 1, the center line 20 of the fiber feeding channel 2 takes a straight course in the drawing shown, i.e. over the entire length of the fiber feeding channel 2. As mentioned earlier, an angle in the transversal sense thereto can even be desirable under certain circumstances and depending on other spinning conditions, as mentioned earlier.

As FIG. 6 shows, the opener device 3 can be on two shafts or axles 7 and 70. Shaft 70 is provided with a catch stop 8 which may be provided with a ball subjected to the force of a spring 1, for example. Shaft 70 is provided with notches which are not shown, in which the ball 80 can catch. The distance between the notches in shaft 70 corresponds here to the division lines of the scale 51 (FIG. 1), i.e. to the distance between one rotor size and the next. It is of course possible to use a different division of scale 51 and to provide correspondingly different distances between the notches if this appears to be useful, e.g. when different settings of the opener device 3 are advantageous with the same rotor diameter to adapt to different rotor forms.

To be able to displace the opener device 3 shown in FIG. 6 easily, the opener device 3 is provided with a bearing 38 that can easily be detached from the shaft 7 and which is made in two parts according to FIG. 6 to achieve easy disassembly. After opening the bearing 38, the opener device 3 is swivelled slightly around shaft 70 and is then displaced parallel to said shaft 70 until the new position has been reached. This can be controlled by means of the scale 51, if one is provided. The catch stop 8 (if provided) can facilitate precise adjustment in this case, but under certain circumstances some other type of arresting device is sufficient, such one that is similar to the device shown in FIGS. 1 and 3, in form of clamping screws (attachment screws 34 and 35).

In the embodiments described so far, the scale 51 is located on a part 5 of the machine frame while the markings interacting with this scale 51 are formed by a lateral edge 301 or 302 of the opener device 3. However, a partial line on an edge of the opener device 3 extending parallel to scale 51 or in a window of a surface of the opener device 3 extending parallel to scale 51 may also be used. It is also possible to locate the scale 51 on the opener device 3 and the markings interacting with it on the part 5 of the machine frame or at some other suitable location, e.g. on a housing (not shown) containing the spinning rotor 1.

The device according to the instant invention can be modified in many different ways, e.g. by replacing characteristics by equivalents or through other variations of the characteristics. Thus it is not absolutely necessary for the opener device 3 to be capable of linear displacement, as is the case in the embodiments described so far. It is also possible to design the opener device 3 so as to be capable of rotation-adjustment by making the device pivotable around the shaft 310 of the opener roller 31, for example, as shown in the dashed lines 100 in FIG. 5. In this manner, the beginning 24 of the fiber feeding channel 2 also changes its position, and this is compensated for by a corresponding placement of the other part of the fiber feeding channel 2 in the rotor cover 10 (see FIG. 5).

If the opener device 3 is rotation-adjustable around the axis of its opener roller 31, a new position of the delivery device 4, including delivery roller 40 is necessary after rotation-adjustment of the opener device 3, and for this reason the delivery device 4 is integrated into the opener device 3 in this embodiment and is also adjusted when the opener device 3 is rotation-adjusted.

Figure 5:
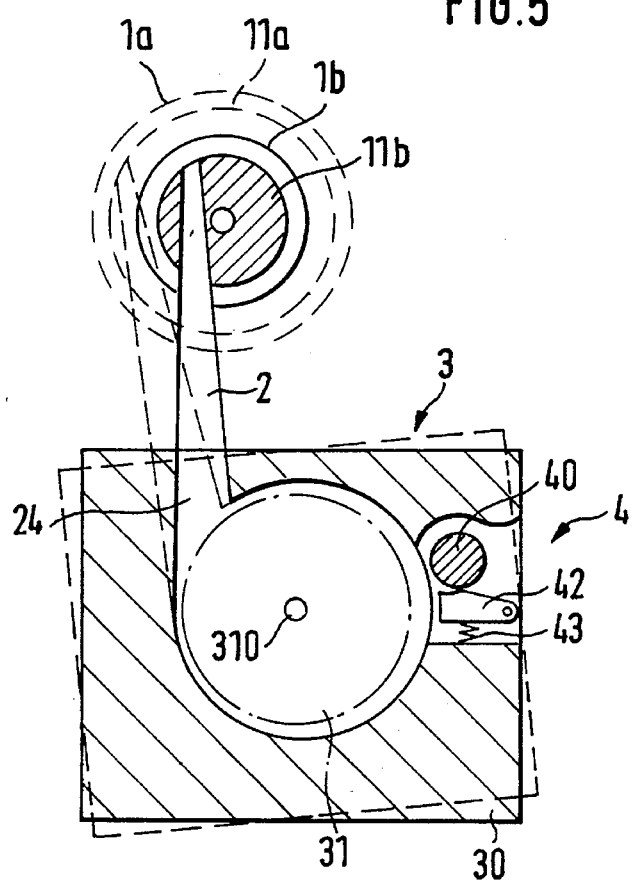
FIG. 5 is a schematic top view of an embodiment of an open-end spinning device with a rotation-adjustable opener device.

If the delivery device 4 is to keep its position, this is made possible through the fact that the axis of the delivery roller 40 is selected as the pivot point of the rotation-adjustable opener device, as shown by the dashed lines 101 in FIG. 5.

Depending on the design of the delivery device 4, the latter may be adjustable together with the opener device 3, as described above. Especially in a design of the device according to FIG. 6, with only one adjusting direction, this is however not required, as the delivery roller 40 extends in the direction of adjustment and is of such length that it is in front of the opener device 3 in every setting position of the latter. Only the feeding trough 42, for which normally a band guide (not shown) is provided, must as a rule be taken along by the opener device 3 or must at least be readjusted to it, so that this band guide may always be in the correct position relative to the opener device 3. In such a design of the device nothing is changed in the drive of the delivery device 4 as compared with the otherwise normally used drive, so that the latter may remain as before on the machine frame.

Similarly, the opener roller 31 may also be provided with an shaft that is extended beyond what is otherwise normal for rollers in order to support a drive wharve (not shown), so that when the opener device 3 is displaced parallel to the shaft of its opener roller 31, this drive wharve is prevented from an axial shift and only the axial distance between opener roller 31 and drive wharve changes.

If the opener device 3 according to FIGS. 2 and 3 is also adjusted in a second or third plane, the differences in distances between the drive of the opener roller 31 and/or of the delivery roller 40 and their drive shaft etc. can be compensated for by a tension roller (not shown) which always holds a drive belt, e.g. a toothed belt connecting the opener roller 31 or the delivery roller 40 for drive to its drive shaft etc. under tension. If some other drive is used, the drive transmission must be ensured by some other appropriate means.

It will be apparent to those skilled in the art that various modifications and variations can be made in the present invention without departing from the scope or spirit of the invention. For example, features illustrated as part of one embodiment can be used on another embodiment to yield a still further embodiment. It is intended that the present invention cover such modifications and variations as come within the scope of the appended claims and their equivalents.

I claim:

1. An open-end spinning device, comprising:

a replaceable spinning rotor of a given diameter provided with an inside wall, a fiber collection groove, and an open side;

an opener device for supplying fibers to said spinning rotor, said opener device comprising an opener roller rotatable about a longitudinal axis;

a machine frame, said opener device being rotatably mounted relative said spinning rotor about a rotational axis on said machine frame, said opener device being variably positionable about said rotational axis in a plane perpendicular to said opener roller longitudinal axis between a plurality of operating positions;

a stationary replaceable rotor cover configured for said given diameter of said spinning rotor and disposed so as to cover said open side of said spinning rotor, said rotor cover stationary relative to said rotatable opener device;

a fiber feeding channel beginning in said opener device and ending in said rotor cover across from said inside wall of said spinning rotor so as to deposit fibers conveyed from said opener device to said inside wall at any of said operating positions of said opener device, at least a portion of said fiber feeding channel being defined through said rotor cover and having dimensions and orientation dependent at least in part upon said given diameter of said spinning rotor; and wherein said opener device is rotatably displaceably mounted relative to said spinning rotor and rotor cover to accommodate different dimensions and orientation of said fiber feeding channel as a result of replacing said spinning rotor and said rotor cover with different sized spinning rotors and rotor covers.

2. The device as in claim 1, wherein said opener device comprises an opener roller having a rotation axis, said longitudinal axis of said opener device corresponding to said rotation axis.

3. The device as in claim 1, wherein said opener device further comprises a delivery device, said opener device is rotatable about a longitudinal axis through said delivery device.

* * * * *